US009285726B2

(12) United States Patent
Takayanagi

(10) Patent No.: US 9,285,726 B2
(45) Date of Patent: Mar. 15, 2016

(54) IMAGE FORMING APPARATUS WITH RECORDING MATERIAL SEPARATION FEATURE

(71) Applicant: CANON KABUSHIKI KAISHA, Tokyo (JP)

(72) Inventor: Hiroki Takayanagi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/526,851

(22) Filed: Oct. 29, 2014

(65) Prior Publication Data

US 2015/0117919 A1 Apr. 30, 2015

(30) Foreign Application Priority Data

Oct. 29, 2013 (JP) ..... 2013-224110

(51) Int. Cl.
*G03G 15/20* (2006.01)

(52) U.S. Cl.
CPC .... *G03G 15/2028* (2013.01); *G03G 2215/2009* (2013.01); *G03G 2215/2016* (2013.01)

(58) Field of Classification Search
CPC ..... G03G 15/2028
See application file for complete search history.

(56) References Cited

U.S. PATENT DOCUMENTS

2004/0091279 A1* 5/2004 Izawa et al. ..... 399/67
2004/0131399 A1* 7/2004 Sahara ..... 399/322

FOREIGN PATENT DOCUMENTS

| | | | |
|---|---|---|---|
| JP | 07-191573 | A | 7/1995 |
| JP | 2002-278329 | A | 9/2002 |
| JP | 2002-341681 | A | 11/2002 |
| JP | 2010-085968 | A | 4/2010 |
| JP | 2010-250054 | A | 11/2010 |
| JP | 2012-048107 | A | 3/2012 |

* cited by examiner

*Primary Examiner* — Sandra Brase
(74) *Attorney, Agent, or Firm* — Fitzpatrick, Cella, Harper & Scinto

(57) ABSTRACT

An image forming apparatus comprises a drum for carrying a toner image; a transfer member for contacting the drum to form a transfer nip, the transfer member being capable of electrostatically transferring the toner image from the drum onto a sheet; a fixing unit provided, downstream of the transfer member with respect to a sheet feeding direction, for fixing the toner image on the sheet by a fixing nip; a first current path provided between the fixing nip and a ground potential; a feeding unit, provided downstream of the fixing unit, for feeding the sheet while nipping by a feeding nip; a guiding member, disposed downstream of the feeding unit, for feeding the sheet passing through the transfer nip; and a second current path provided between the feeding nip and the ground potential, the second path having an electric resistance which is lower than that of the first path.

6 Claims, 6 Drawing Sheets

(a)

(b)

(a)

(b)

IMAGE FORMING APPARATUS WITH RECORDING MATERIAL SEPARATION FEATURE

FIELD OF THE INVENTION AND RELATED ART

The present invention relates to an image forming apparatus which transfers a toner image onto a sheet of transfer medium, in its transfer section, and then, fixes the toner image with its fixing device.

There have been widely used such image forming apparatuses that transfer a toner image borne by their image bearing component (photosensitive component or intermediary transferring component), onto a sheet of transfer medium, in its transfer section, and then, applies heat and pressure to the toner image with the use of their fixing device to fix the toner image to the sheet of transfer medium. In the case of an image forming apparatus, transfer section of which is the area of contact between its image bearing member and transfer roller, its transfer section is provided with an electric field to electrostatically transfer the toner image on its image bearing member, onto the sheet of transfer medium, while the sheet remains pinched between the image bearing member and transfer roller.

After the transfer of the toner image onto the sheet of transfer medium in the transfer section, the sheet remains electrostatically adhered to the image bearing member. Therefore, the sheet has to be quickly separated from the image bearing member, on the downstream side of the transfer section, after the transfer of the toner image. After the separation of the sheet of transfer medium from the image bearing member, the sheet is guided to the nip portion of the fixing device.

There is disclosed in Japanese Laid-open patent application 2010-85968, an image forming apparatus having a fixing device, the nip of which is the area of contact between its fixing belt and pressure roller. More specifically, the image forming apparatus is provided with a metallic guide, which is disposed on the upstream side of the pressure roller. Thus, the sheet of transfer medium is transferred from the guide onto the pressure roller to convey the sheet to the nip of the fixing device.

If transfer medium is left unattended in an environment which is high in humidity for a substantial length of time, the transfer medium absorbs a substantial amount of humidity. If transfer medium having a substantial amount of humidity is used by an image forming apparatus in which voltage is applied to a sheet of transfer medium while the sheet remains pinched between its pressure roller and image bearing member, there occurs sometimes the following problem. That is, as a sheet of transfer medium absorbs humidity, it reduces in electrical resistance. However, as long as the components which come into contact with the sheet of recording medium, on the downstream side of the transfer section of the apparatus, are all high in electrical resistance, practically no electric current flows from the sheet of transfer medium. Therefore, the entirety of the sheet of transfer medium remains roughly the same in electrical potential level as the peripheral surface of the transfer roller.

However, in a case where the downstream portion of the sheet of transfer medium, which has been reduced in electrical resistance by the humidity absorbed by the sheet, comes into contact with the sheet discharge guide, for example, while the upstream portion of the sheet is remaining pinched in the transfer section, the sheet of transfer medium is electrostatically adhered to the sheet discharge guide. Thus, the friction between the sheet and sheet discharge guide adds to the resistance to the sheet conveyance. Therefore, the apparatus is likely to become unstable in terms of transfer medium conveyance.

As for the means for preventing a sheet of transfer medium from being electrostatically adhered to the sheet discharge guide, it is possible to place on the upstream side of the sheet discharge guide, a component which can be grounded through other components which are low in electrical resistance, in order to reduce the sheet of transfer medium in electrical potential. However, even though reducing the sheet of transfer medium in potential can prevent the problem that the sheet unsatisfactorily is conveyed along the sheet discharge guide, it sometimes creates another problem, which is related to the separation of the sheet from the image bearing member on the downstream side of the transfer section, as will be described later.

That is, as a sheet of transfer medium receives electrical charge in the transfer section, it is electrostatically adhered to the image bearing member. Thus, it is likely to be unsatisfactorily separated from the image bearing member on the downstream side of the transfer section. Therefore, an electrically conductive and flat component which is capable of electrostatically attracting the sheet of transfer medium is disposed in the downstream adjacencies of the transfer section, in order to assist the separation of the sheet of transfer medium. Therefore, as the sheet of transfer medium is reduced in electrical potential to prevent the sheet of transfer medium from being adhered to the sheet discharge guide, the flat component also is reduced in the electrostatic force which attracts the sheet. Consequently, the flat component reduces in its ability to separate the sheet of transfer medium from the image bearing member. That is, it is possible for the sheet of transfer medium to be unsatisfactorily separated from the image bearing member.

SUMMARY OF THE INVENTION

According to an aspect of the present invention, there is provided an image forming apparatus comprising a rotatable image bearing member configured to carry a toner image; a transfer member configured to contact said image bearing member to form a transfer nip, said transfer member being capable of electrostatically transferring the toner image from said image bearing member onto a recording material using an electric field applied to said transfer portion; a fixing unit provided downstream of said transfer member with respect to a feeding direction of a recording material and configured to fix the toner image on the recording material having the transferred toner image fed into a fixing nip; a first current path provided between said fixing nip and a ground potential; a feeding unit provided downstream of said fixing unit with respect to the feeding direction and configured to feed the recording material while nipping by a feeding nip; a guiding member disposed downstream of said feeding unit with respect to the feeding direction and configured to feed the recording material passing through said transfer nip; and a second current path provided between said feeding nip and the ground potential, said second current path having an electric resistance which is lower than that of said first current path.

Further features of the present invention will become apparent from the following description of exemplary embodiments with reference to the attached drawings.

DESCRIPTION OF THE PREFERRED EMBODIMENTS

Hereinafter, some of the preferred embodiments of the present invention are described in detail with reference to the appended drawings.

Embodiment 1

Image Forming Apparatus

Figure 1:
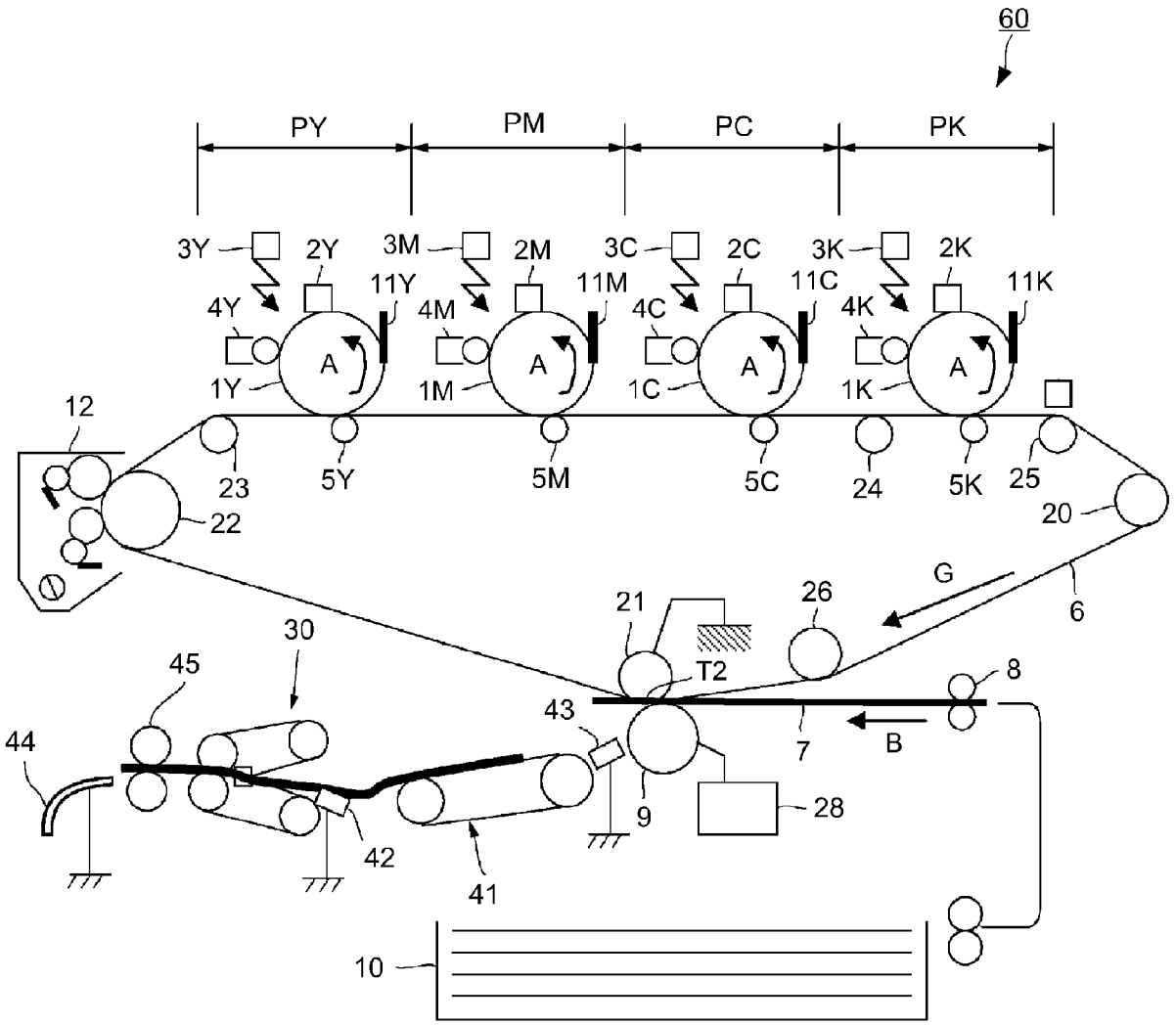
FIG. 1 is a drawing for describing the structure of a typical image forming apparatus to which the present invention is applicable.

FIG. 1 is a drawing for describing the structure of image forming apparatus in this embodiment. Referring to FIG. 1, the image forming apparatus 60 is a full-color printer of the so-called tandem type, and also, of the so-called intermediary transfer type. That is, it has yellow, magenta, cyan and black image formation sections PY, PM, PC and PK, respectively, and an intermediary transferring belt 6, along which the image formation sections PY, PM, PC and PK are sequentially disposed.

In the image formation section PY, a yellow toner image is formed on a photosensitive drum 1Y, and is transferred onto the intermediary transfer belt 6 (primary transfer). In the image formation section PM, a magenta toner image is formed on a photosensitive drum 1M, and is transferred onto the intermediary transfer belt 6 (primary transfer). In the image formation sections PC, and PK, cyan toner image and black toner image are formed on the photosensitive drum 1C and 1K, and are transferred onto the intermediary transfer belt 6 (primary transfer).

Sheets 7 of transfer medium are moved out one by one from a cassette 10. Then, each sheet 7 is kept on standby by a pair of registration rollers 8. Then, each sheet 7 is conveyed to a transfer section T2 by the pair of registration rollers 8 with the same timing as that with which the toner image on the intermediary transfer belt 6 arrives at the transfer section T2. Then, as the sheet 7 is conveyed through the transfer section T2, the toner image on the intermediary transfer belt 6 is transferred onto the sheet 7 of transfer medium (secondary transfer). After the transfer of the four toner images, different in color, onto the sheet 7 of transfer medium, the sheet 7 is conveyed to a fixing device 30, in which the sheet 7 and toner images thereon are subjected to heat and pressure to fix the toner images. Then, the sheet 7 is discharged from the main assembly of the image forming apparatus 60.

(Image Formation Section)

Referring to FIG. 1, the image formation sections PY, PM, PC and PK are practically the same in structure although they are different in the color (yellow, magenta, cyan and black) of the toner used by their developing devices 4Y, 4M, 4C and 4K. Hereafter, therefore, only the image formation section PY, or the image formation section for forming a yellow toner image, is described in order not to repeat the same description.

The image formation section PY (PM, PC, PK) has the photosensitive drum 1Y (1M, 1C, 1K), and a charging device 2Y (2M, 2C, 2K) of the corona type, an exposing device 3Y (3M, 3C, 3K), a developing device 4Y (4M, 4C, 4K), a transfer roller 5Y (5M, 5CM 5K), and a drum cleaning device 11Y (11M, 11C, 11K), which are disposed in the adjacencies of the peripheral surface of the photosensitive drum 1Y. The photosensitive drum 1Y is made up of an aluminum cylinder, and a photosensitive layer which covers virtually the entirety of the peripheral surface of the aluminum cylinder. It rotates in the direction indicated by an arrow mark A. The charging device 2Y of the coronal type exposes the peripheral surface of the photosensitive drum 1Y to the charged particles generated by corona discharge, to uniformly and negatively charge the peripheral surface of the photosensitive drum 1Y to a potential level VD (pre-exposure level). The exposing device 3Y scans (exposes) the peripheral surface of the photosensitive drum 1Y with the beam of laser light, to form an electrostatic image which corresponds to the image to be formed.

The developing device 4Y stirs developer, which is a mixture of toner and carrier, to charge the toner and carrier to negative and positive polarities, respectively. Then, it causes its development sleeve to bear the developer in such a manner that the developer on the development sleeve crests, in order to develop the electrostatic image on the photosensitive drum 1Y, into a toner image. Then, an oscillatory voltage, that is, a combination of a negative DC voltage Vdc and AC voltage, is applied to the development sleeve to cause the toner on the development sleeve to transfer onto the photosensitive drum 1Y in the pattern of the electrostatic image on the photosensitive drum 1Y.

The transfer roller 5Y forms a toner image transfer section between the photosensitive drum 1Y and intermediary transfer belt 6. As positive DC voltage is applied to the transfer roller 5Y, the toner image borne by the photosensitive drum 1Y is transferred onto the intermediary transfer belt 6.

The transfer roller 5Y is made up of a metallic core, more specifically, a piece of round stainless steel rod, and an elastic layer which is formed of ion-conductive foamed rubber and covers virtually entirety of the peripheral surface of the metallic core. The transfer roller 5Y is 15-20 mm in diameter. When it is in an environment which is normal in temperature and humidity (N/N: 23° C., 50% RH), its electrical resistance is $1\times10^5$-$1\times10^8\Omega$ when 2 kV is applied. To the transfer roller 5*y*, +1-+5 kV of transfer voltage is applied to cause +15-+70 μA of transfer current to flow.

(Intermediary Transfer Belt)

The intermediary transfer belt 6 is suspended and kept stretched by a combination of a tension roller 22, a driver roller 20, and a secondary transfer inward roller 21 as well as auxiliary rollers 23, 24, 25, 26. The tension roller 22 provides the intermediary transfer belt 6 with a preset amount of tension by being kept pressed by unshown springs, outward of the loop which the transfer belt 6 forms. The driver roller 20 rotationally drives the intermediary transfer belt 6 in the direction indicated by an arrow mark G at a peripheral velocity preset in a range of 150-360 mm/sec.

When the intermediary transfer belt 6 is in an environment which is normal in temperature and humidity (N/N: 23° C., 50% RH), it is in a range of $1\times10^8$-$1\times10^{14}$ [Ω·cm] in volume resistivity; 60-80° in MD1 hardness; and 0.2-0.6 in coefficient of static friction, which was measured with the use of type 94i (product of Heidon Co., Ltd.).

The intermediary transfer belt 6 is made up of a substrative layer, an elastic layer, and a surface layer. The substrative layer is 0.05-0.15 [mm] in thickness, and is formed of polyamide, polycarbonate, or the like resinous substance, or one of various rubbers, which contains carbon black, as charge prevention agent, by a proper amount. The elastic layer is 0.1-0.5 [mm] in thickness, and covers the entirety of the peripheral surface of the outward surface of the substrative layer. It is formed of CR rubber, urethane rubber, or the like rubber which contains carbon black, as charge prevention agent, by a proper amount. The surface layer is formed of fluorinated resin or the like which is excellent in parting properties. It has a thickness of 0.0005-0.020 mm.

(Secondary Transfer Section)

The secondary transfer roller 9 forms the second transfer section T2 which transfers the toner image onto a sheet of transfer medium, by being placed in contact with the intermediary transfer belt 6, which is supported (backed up) by the secondary transfer inward roller 21. The foam of which the surface layer of the secondary transfer roller 9 is made is very small in cell dimension; the cell count of the surface layer is no less than 5 per 2 mm.

The secondary transfer roller 9 is made up of a metallic core, more specifically, a piece of round stainless steel rod, and an elastic layer which is formed of ion-conductive foamed rubber and covers virtually entirety of the peripheral surface of the metallic core. It is 20-25 mm in diameter. When it is in an environment which is normal in temperature and humidity (N/N: 23° C., 50% RH), its electrical resistance is in a range of $1\times10^5$-$1\times10^8\Omega$ when 2 kV is applied. The secondary transfer inward roller 21 is made up of a metallic core, more specifically, a piece of round stainless steel rod, and an elastic layer which is formed of ion-conductive foamed rubber and covers virtually entirety of the peripheral surface of the metallic core. The secondary transfer inward roller 21 is 20-22 mm in diameter. When it is in an environment which is normal in temperature and humidity (N/N: 23° C., 50% RH), its electrical resistance is in a range of $1\times10^5$-$1\times10^8\Omega$ when 50V is applied.

The secondary transfer inward roller 21 is grounded. To the secondary transfer roller 9, a preset mount of transfer voltage that is opposite in polarity from the toner image is applied from an electrical power source 28. For example, +1-+7 kV of transfer voltage is applied to cause +40-+120 μA of transfer current to flow, in order to transfer the toner image on the intermediary transfer belt 6 onto a sheet 7 of transfer medium. Residual toner can be removed from intermediary transfer belt 6 by a toner removal unit 12.

(Fixing Device)

Figure 2:
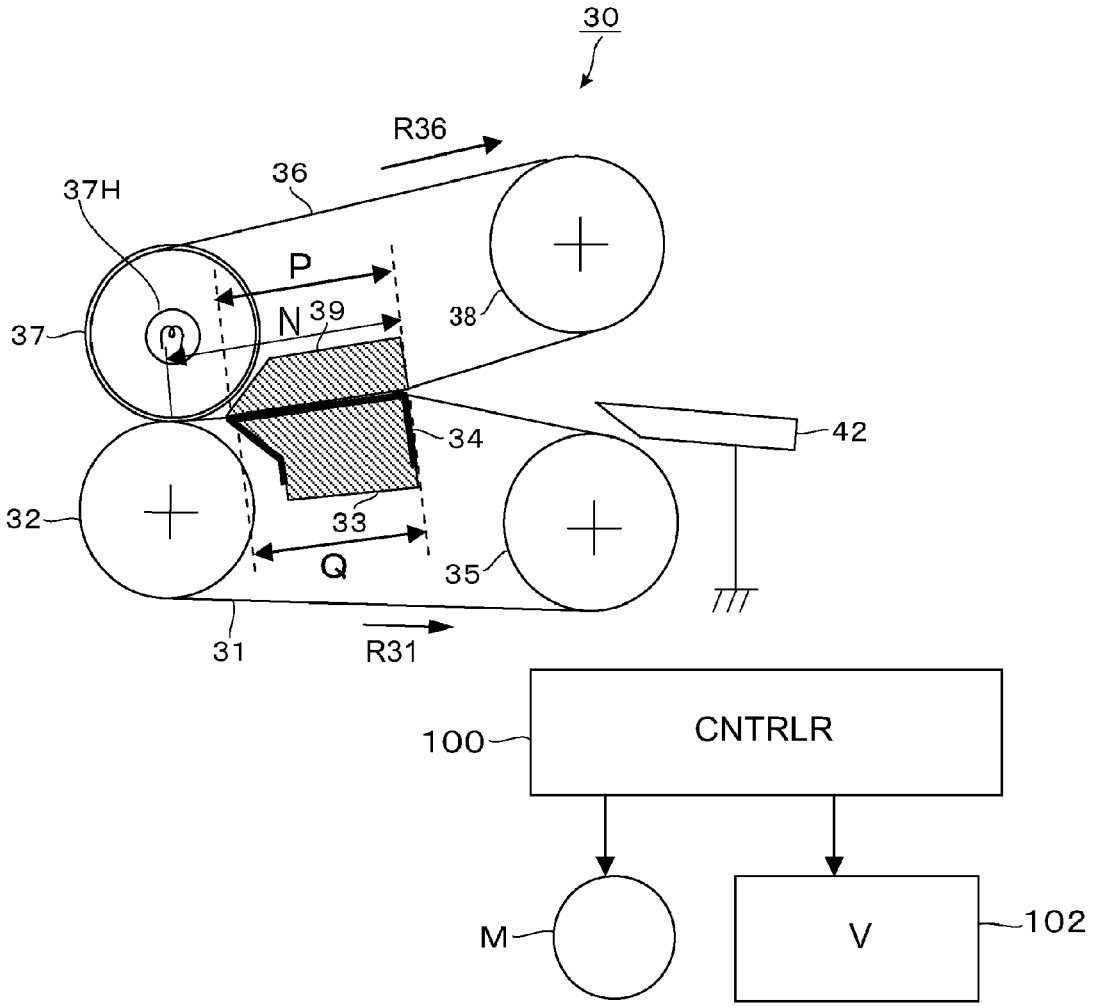
FIG. 2 is a drawing for describing the structure of a fixing device which is compatible with the present invention.
Figure 3:
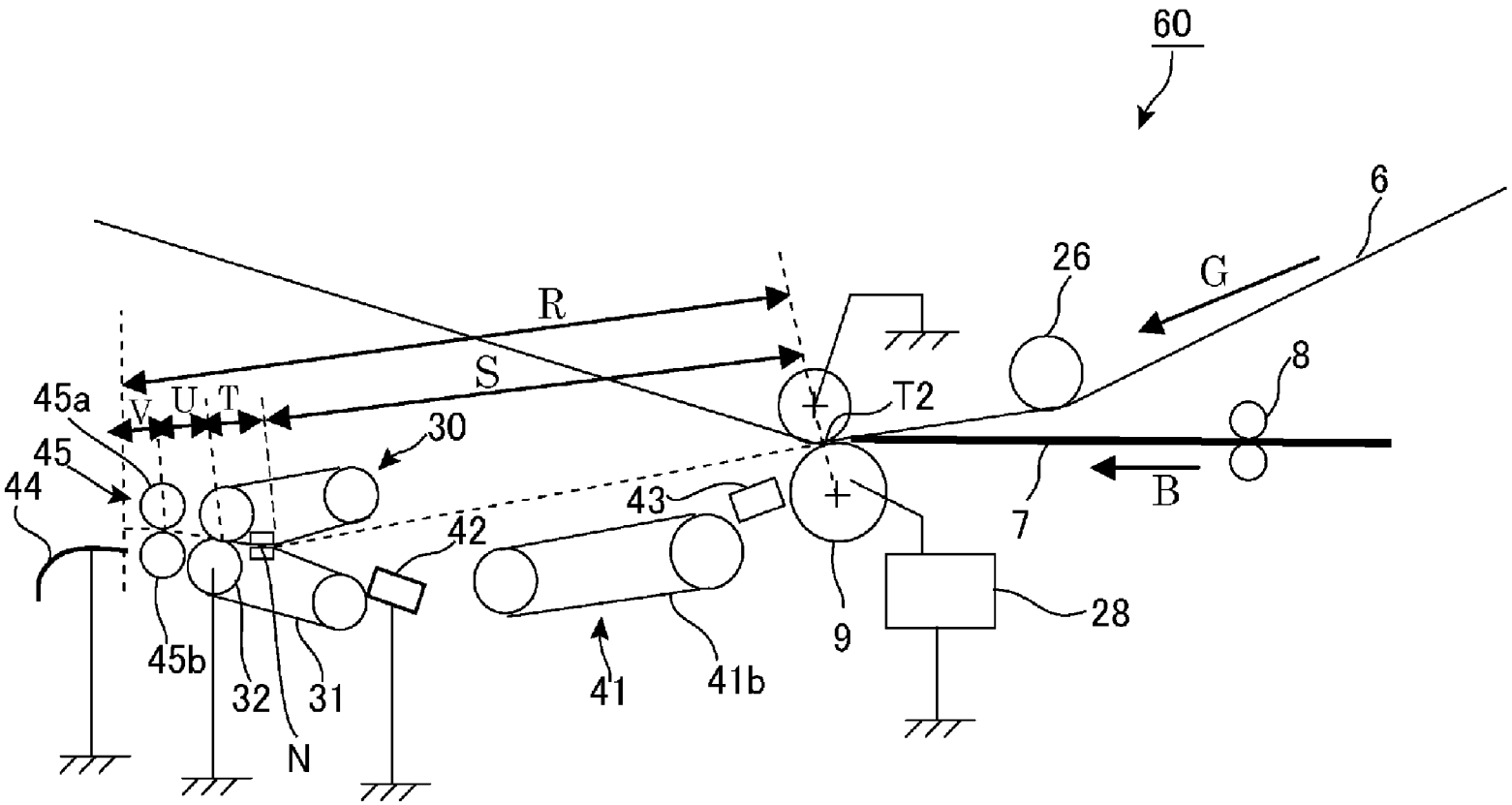
FIG. 3 is a drawing for describing the portion of the transfer medium conveyance passage, which is between the second transfer section and the fixing device.

FIG. 2 is a drawing for describing the structure of the fixing device. FIG. 3 is a drawing for describing the portion of the transfer medium conveyance passage, which extends from the secondary transfer section to the fixing device.

Referring to FIG. 2, the fixing device 30 is an image heating device of the so-called twin belt nip type, which forms a nip N (transfer medium nipping portion) between a fixing belt 36 and a pressure belt 31. A control section 100 controls the fixing device 30 in such a manner that as a sheet 7 of transferring medium, on which an unfixed toner image is borne, is conveyed through the nip N, the sheet and the toner image thereon are heated by the heat from the fixing belt 36, and also are subjected to the nip pressure. Thus, as the sheet is conveyed through the fixing device 30, the unfixed toner image on the sheet is fixed to the sheet. After being moved through the nip N, the sheet is given by the pressure roller 32 such curvature that causes the sheet to separate from the surface of the fixing belt 36, and therefore, it separates from the surface of the fixing belt 36 as if it is peeled away from the fixing belt 36.

The fixing belt 36 is an endless belt. It is suspended by and between a tension roller 38 and a fixing roller 37, on the top side of the pressure belt 31. The fixing belt 36 is a multilayer (two-layer) belt. That is, it is made up of a metallic belt as a substrative layer, and a parting layer (elastic layer) which is formed of fluorinated resin (PFA or PTFE, for example) and covers the outward surface of the substrative layer. The metallic belt is 50-70 mm in internal diameter, and 55-75 μm in thickness. The parting layer is 30-50 μm in thickness, and is flexible. It is $1\times10^8$ [Ω·cm]-$1\times10^{10}$ [Ω·cm] in volume resistivity.

The fixing roller 37 is made up of a hollow metallic roller and an elastic layer. It is 18.6-26.4 mm in external diameter. The metallic roller is 18-25 mm in external diameter and is formed of SUS or the like metallic substance. The elastic layer is formed of silicone rubber (30° in JIS-A hardness, and 1.0 W/m° K in thermal conductivity, for example). It is bonded to the peripheral surface of the metallic roller. It is 0.3-0.7 mm in thickness. There is disposed in the hollow of the metallic roller, a halogen heater 37H, as a heat source, to which electric power is supplied from an electric power source 102.

The pressure belt 31 is an endless belt. It is suspended by and between a tension roller 35 and a pressure roller 37, on the bottom side of the fixing belt 36. The pressure belt 31 is a multilayer (two-layer) belt. That is, it is made up of a metallic belt as a substrative layer, and a parting layer (elastic layer) which is formed of fluorinated resin (PFA or PTFE, for example) which contains carbon or the like electrically conductive agent, and covers the outward surface of the substrative layer. The metallic belt is 50-70 mm in internal diameter, and 40-80 μm in thickness. The parting layer is 20-90 μm in thickness, and is flexible. It is $1\times10^8$ [Ω·cm]-$1\times10^{10}$ [Ω·cm] in volume resistivity.

The pressure belt 31 is supported by the pressure roller 32 and a pressure pad 33, by its inward surface, in terms of the loop which the pressure belt 31 forms. The fixing belt 36 is supported by the fixing roller 37 and a fixing pad 39, by its inward surface in terms of the loop which the fixing belt 36 forms. The pressure belt 31 is kept pressed upon the fixing belt 36, by a preset amount of pressure. The width P of the fixing pad 39 in terms of the direction in which the fixing belt 36 is conveyed is 15-19 mm. The width Q of the pressure pad 33 in terms of the direction in which the pressure belt 31 is conveyed is 9-14 mm, which is less than the width P of the fixing pad 39. The surface of the pressure pad 33, upon which the pressure belt 31 slides, is covered with a low-friction sheet 34, which the inward surface of the pressure belt 31 rubs.

The lengthwise ends of the pressure roller 32 are rotatably supported by the pair of lateral plates of the casing of the fixing device 30, with the placement of a pair of bearings between the lengthwise ends of the pressure roller 32 and the lateral plates, one for one. The unshown pressure application mechanism attached to the lateral plates of the casing of the fixing device 30 keeps upwardly pressed, the lengthwise ends of the pressure roller 32, and those of the pressure pad 33, to keep pressed the pressure roller 32 and pressure pad 33 against the fixing roller 37 and fixing pad 39, respectively, with the presence of the pressure belt 31 and fixing belt 36 between the pressure roller 32 and fixing roller 37, and between the pressure pad 33 and fixing pad 39, so that a preset amount of pressure (total load of 784 N (80 kgf), for example) is maintained between the fixing belt 36 and pressure belt 31.

Referring to FIG. 3, a discharge roller pair 45 is made up of a pair of rollers 45*a* and 45*b* which are kept in contact with each other. The rollers 45*a* and 45*b* are made up of a metallic roller, which is 12-18 mm in external diameter, and a piece of tube which covers the peripheral surface of the metallic roller. The tube is made of PFA which was made electrically conductive by carbon or the like electrical conductive agent dispersed in PFA. The PFA tube is no more than $1\times10^6$ [Ω·cm] in volume resistivity, and is 10-100 μm in thickness. The rollers 45*a* and 45*b* may be left bare across their peripheral surface. In this embodiment, however, their surface is covered with the PFA tube to provide the peripheral surface of the rollers 45*a* and 45*b* with a certain amount of flexibility, in order to minimize the scars which the surfaces of a sheet of transfer medium might suffer when the sheet is conveyed by the discharge roller pair 45 while remaining pinched by the rollers 45*a* and 45*b*.

(Post-Secondary-Transfer Sheet Guide, Fixing Device Entrance Guide, and Pre-Fixation Sheet Conveyance Device)

Figure 4:
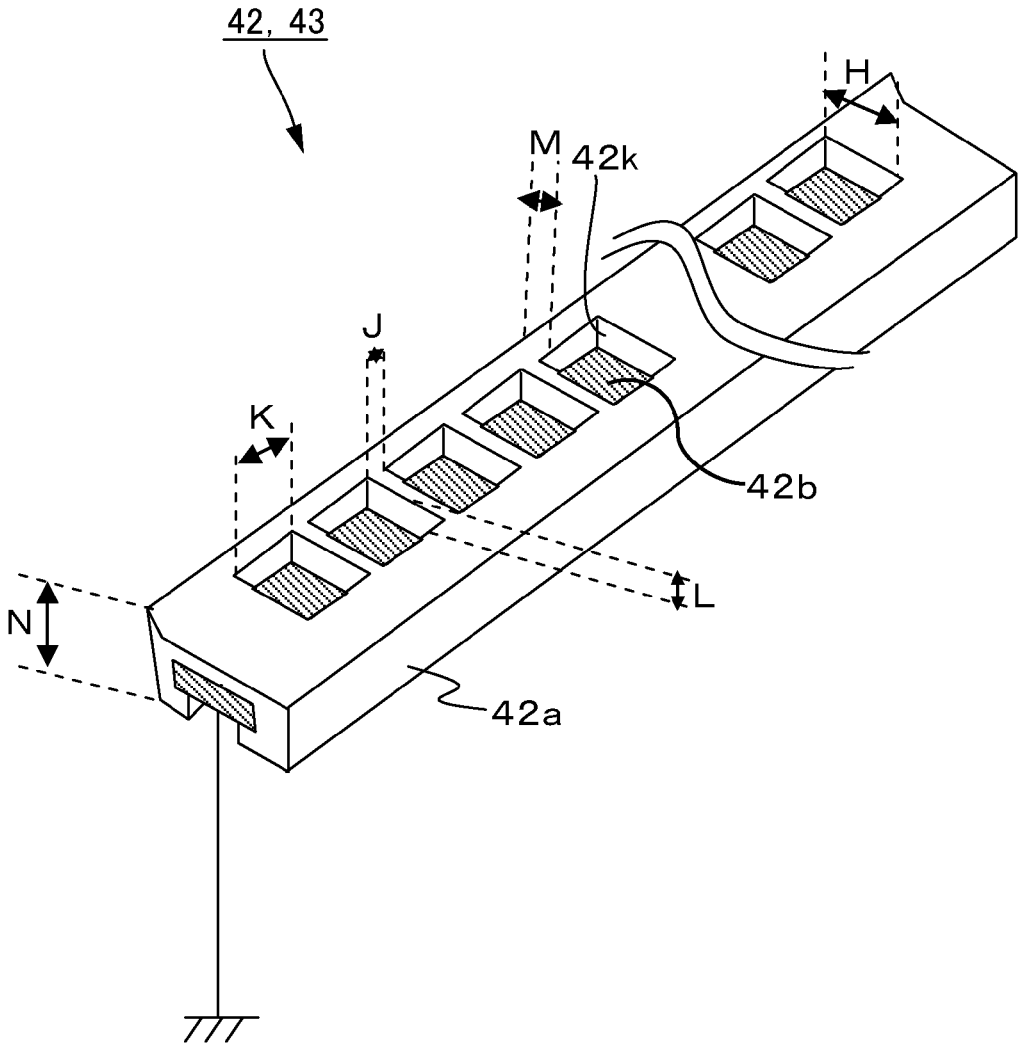
FIG. 4 is a drawing for describing the structure of the transfer medium guide in the immediate downstream adjacencies of the secondary transfer section, and that of the fixation device entrance guide.

FIG. 4 is a drawing for describing the structure of the post-secondary-transfer guide and the structure of the fixation device entrance guide. Referring to FIG. 3, after a toner image is transferred onto a sheet 7 of transfer medium in the secondary transfer section T2, the sheet 7 is guided to the pre-fixation sheet conveyance device 41 by the post-secondary-transfer guide 43, and then, is conveyed to the fixing device 30 through the fixation device entrance guide 42 from the pre-fixation sheet conveyance device 41.

After being subjected to a transfer electric field in the secondary transfer section T2, the sheet of transfer medium remains electrostatically attracted to the photosensitive drum 1Y. Thus, the sheet is likely to be unsatisfactorily separated from the photosensitive drum 1Y. Thus, in order to stabilize the conveyance of the sheet of transfer medium after the sheet comes through the secondary transfer section T2, it is necessary to electrically attract the sheet by the post-secondary-transfer guide 43 disposed in the immediately downstream adjacencies of the secondary transfer section T2, to enable the sheet to reliably separate from the intermediary transfer belt 6.

Referring to FIG. 4, the post-secondary-transfer guide 43 is 30-50 mm in width in terms of the transfer medium conveyance direction, 350 mm in length in terms of the direction perpendicular to the transfer medium conveyance direction, and 5-7 mm in height at its end which is close to the pre-fixation sheet conveyance belt (41*b* in FIG. 3). The post-secondary-transfer guide 43 is made up of a piece of aluminum plate 42*b*, which is 0.8-1.5 mm in thickness, and a resin layer 42*a* which is 0.2-1.0 mm in thickness and partially covers the aluminum plate 42*b*. The resin layer 42*a* is formed of PP, PBT, PES, ABS, or the like resin.

The transfer medium bearing surface of the resin layer 42*a* is provided with multiple holes 42*k*. In terms of the transfer medium conveyance direction which is roughly parallel to the surface of the sheet of transfer medium, the width H of each hole 42*k* is 10-30 mm. In terms of the direction perpendicular to the transfer medium conveyance direction, the width K of each hole 42*k* of the resin layer 42*a* is 3-7 mm, 11-15 mm, or 18-20 mm. That is, the holes 42*k* of the resin layer 42*a* may be different in the width K in terms of the direction perpendicular to the transfer medium conveyance direction. The width J of the rib between the adjacent two holes 42*k* is 1-3 mm.

The metallic plate 42*b* of the post-secondary-transfer guide 43 is grounded. Therefore, the post-secondary-transfer guide 43 electrostatically attracts the sheet of transfer medium without the need for placing the sheet of transfer medium in contact with the metallic plate 42*b* after the application of voltage to the sheet by the secondary transfer roller 9. Therefore, the sheet is reliably separated from the image bearing member, on the downstream side of the secondary transfer section T2.

The fixation device entrance guide 42 is a component for guiding a sheet of transfer medium to the nip of the fixing device 30 after the sheet is conveyed through the secondary transfer section T2. The guide 42 is the same in structure as the guide 43. That is, the metallic plate 42*b* of the guide 42 is also grounded. Therefore, the guide 42 electrostatically attracts the electrically charged sheet of transfer medium while preventing the sheet from coming in contact with the metallic plate 42*b*. Thus, it stabilizes the conveyance of the sheet of transfer medium to the fixing device 30.

Next, referring to FIG. 3, the sheet 7 of transfer medium is introduced into the fixing device 30 by the pre-fixation sheet conveying device 41 which is on the immediacy upstream side of the fixing device 30. Then, the sheet 7 is subjected to the process for fixing the toner image on the sheet 7 to the sheet 7. The pre-fixation sheet conveying device 41 is made up of a pre-fixation sheet conveyance belt 41*b*, which is formed of EPDM or the like rubbery substance, is 100-110 mm in width, 1-3 mm in thickness, and is circularly moved. It bears the sheet 7 to convey the sheet 7. The pre-fixation sheet conveyance belt 41*b* has multiple holes which are 3-7 mm in diameter. It is suctioned from the inward side of the loop it forms, by a fan, in order to ensure the sheet 7 is reliably held thereto so that the sheet 7 is reliably conveyed.

(Characteristic Features of Image Forming Apparatus in Embodiment 1)

Figure 5:
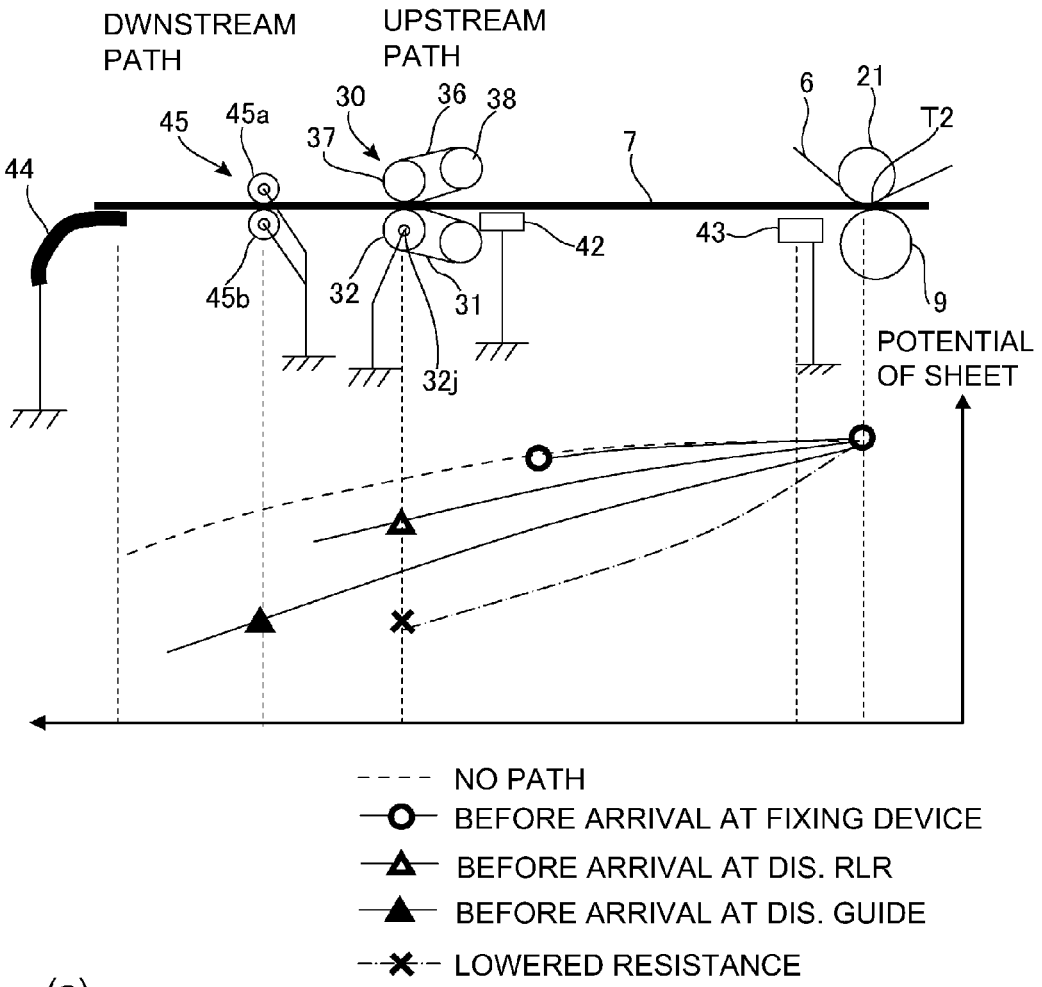
FIG. 5 is a drawing for describing the system, in the first embodiment of the present invention, for controlling in potential level, the transferring component after the secondary transfer.
Figure 5:
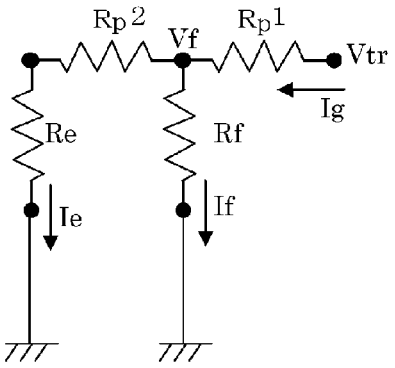

FIG. 5 is a drawing for describing the structure of the system, in the first embodiment, for controlling transfer medium in potential level after the secondary transfer. Referring to FIG. 3, as transfer medium is left unattended for a substantial length of time in an environment which is high in humidity, it is likely to absorb a substantial amount of moisture. Thus, it is likely to significantly reduce in electrical resistance, by an amount large enough for the potential level of the transfer medium to become close to the voltage of the secondary transfer roller 9, while the transfer medium remains pinched by the secondary transfer section T2.

If the components which come into contact with the transfer medium, in the fixing device 30, is very high in electrical resistance (or dielectric), virtually no electric current flows out of the transfer medium, and therefore, the voltage of the transfer medium remains roughly the same as that of the secondary transfer roller 9 across the entirety of the transfer medium. If the transfer medium is conveyed to the discharge guide 44 while remaining high in voltage, the transfer medium is electrically adhered to the discharge guide 44, increasing thereby the friction between the transfer medium and discharge guide 44. Thus, it is possible for the transfer medium to become unstable in the state in which it is conveyed.

On the other hand, if the components which come into contact with the transfer medium, in the fixing device 30, are low in electrical resistance (or short-circuited), the transfer medium is electrically discharged, and therefore, it does not occur that the transfer medium electrically adheres to the discharge guide 44. However, the transfer medium is reduced in performance in terms of its separation from the post-secondary-transfer guide 43. That is, the transfer medium reduces in potential level, reducing thereby in its ability to electrically adhere to the post-secondary-transfer guide 43. Therefore, it reduces in its ability to be guided to the nip N by the fixing device entrance guide 42. If the transfer medium is reduced in potential to prevent it from being adhered to the discharge guide 44, it makes insufficient the amount of force by which it is adhered to the post-secondary-transfer guide 43. Consequently, the image forming apparatus 60 becomes unstable in the conveyance of the transfer medium by the post-secondary-transfer guide 43.

In this embodiment, therefore, it was made possible for the voltage between the nip N of the fixing device 30 and the ground to be kept within a proper range, which is between the ground potential level and the voltage applied to the secondary transfer roller 9, even under the condition in which thin paper, which is likely to cause problems related to transfer medium conveyance, is used as recording medium. That is, the difference in potential level between the transfer medium and ground, which occurs while the transfer medium is conveyed along the post-secondary-transfer guide 43, is kept within a proper range which is between the potential level of the ground and the voltage applied to the secondary transfer roller 9. That is, while the difference in potential level between the transfer medium and ground, which occurs while the transfer medium is conveyed, is increased, the difference in potential level between the transfer medium and ground, which occurs while the transfer medium is conveyed along the discharge guide 44, is reduced. Thus, not only is the transfer medium electrically attracted to the post-secondary-transfer guide 43, but also, it is avoided that the transfer medium conveyance resistance is increased by the electrical attraction of the transfer medium to the discharge guide 44.

Referring to FIG. 3, the definitions of distances S, T, U and V in the first embodiment are as follows:

(1) Distance S is the distance from the secondary transfer section T2, which is the point of contact between the secondary transfer inside roller 21 and secondary transfer roller 9, to the entrance of the nip N which is the area of contact between the fixing belt 36 and pressure belt 31, which is attributable to the pressure pad 33 and fixing pad 39. The distance S in this embodiment is 180 mm.

(2) Distance T is the distance from the entrance of the nip N to the point of contact (indirect contact) between the pressure roller 32 and fixing roller 37. The distance T in the first embodiment is 20 mm.

(3) Distance U is the distance from the point of contact (indirect) between the pressure roller 32 and fixing roller 37 to the point of contact between the roller 45*a* and 45*b* of discharge roller pair 45. In this embodiment, it is 70 mm.

(4) Distance V is the distance from the point of contact between the rollers 45*a* and 45*b* of the discharge roller pair 45 to the discharge guide 44. In this embodiment, it is 15 mm.

(5) Distance R is the distance from the secondary transfer section T2 to the discharge guide 44. In this embodiment, it is 285 mm.

In this embodiment, there is the following mathematical relationship:

$$R=S+T+U+V.$$

In the first embodiment, the sheet of transfer medium is no less than 297 mm in length in terms of the transfer medium conveyance direction, and 330 mm in width (transfer medium width) in terms of the direction perpendicular to the transfer medium conveyance direction. The transfer medium is in a range of 52-150 [g/m$^2$] in basis weight, or weight per unit area, is in a range of $1\times10^7$-$5\times10^8$ [Ω/□] in surface resistivity, and is in a range of $1\times10^7$-$5\times10^8$ [Ω·cm] in volume resistivity.

Referring to FIG. 4, although the post-secondary-transfer guide 43 and the metallic plate 42*b* of the fixation entrance guide 42 are grounded, they are electrically insulated by the resin layer 42*a*. Therefore, no electric current flows between them and the transfer medium. On the other hand, the discharge guide 44 is grounded. Therefore, the higher the transfer medium is in electrical potential, the more electrically strongly it is attracted to the discharge guide 44. Further, the electrical resistance of the fixing device 30, which is a part of the electric current passage on the upstream side of the transfer medium conveyance passage, is greater than that of the discharge roller 45, which is a part of the electric current passage of the downstream side of the transfer medium conveyance passage. Therefore, not only is the transfer medium reliably and preferably separated after the secondary transfer, but also, it is reliably and preferably conveyed thereafter.

Referring to FIG. 5(*b*), a referential code Rp1 stands for the amount of electrical resistance of the portion of a sheet of transfer medium, which is between the secondary transfer roller 9 and fixing device 30, and a referential code Rp2 stands for the amount of electrical resistance of the portion of the sheet of transfer medium, which is between the fixing device 30 and discharge roller pair 45. Next, referring to FIG. 5(*a*), if Rp1=Rp2=$10^{12}$Ω or greater, there will be practically no upstream electrical current passage, nor the downstream electric current passage. That is, no electric current flows to the ground through the transfer medium. Therefore, it does not occur that the transfer medium is reduced in voltage by the electric current which might have flowed through the resistance Rp1, nor does it occur that the transfer medium is reduced in voltage by the electric current which might have flowed through the resistance Rp2. In other words, if there is reduction in the potential level of the transfer medium, it attributable to self-induced attenuation. In this case, while the transfer medium is on the post-secondary-transfer guide 43, it remains high in potential level, and therefore, it reliably separates from the image bearing member. However, it remains high in potential level even as it arrives at the discharge guide 44. Therefore, it is electrically strongly attracted to the discharge guide 44, and therefore, is unreliably conveyed. That is, the friction between the transfer medium and discharge guide 44 becomes a large amount of resistance to transfer medium conveyance. Therefore, in a case where transfer medium such as thin paper which is low in rigidity is used as recording medium, it is likely to be conveyed askew and/or suffer from the like problems.

In the first embodiment, therefore, the fixing device 30 is provided with an electric current passage to allow electric current to flow to the resistance Rp1 through the transfer medium, in order to induce voltage reduction in the transfer medium, so that the transfer medium is reduced in potential level by the time it arrives at the discharge guide 44. In the first embodiment, the upstream electric current passage, which is provided between the secondary transfer section T2 and discharge guide 44, consists of the fixing device 30. That is, the pressure belt 31 of the fixing device 30 is grounded through the shaft of the pressure roller 32 and that of the tension roller 35. The nip which the pressure roller 32 and fixing roller 37 form with the presence of the pressure belt 31 between the two rollers 32 and 37, and by which the transfer medium is nipped, is roughly 1-3 mm in terms of the transfer medium conveyance direction. The electric current having flowed to this nip through the transfer medium flows to the ground through the pressure belt 31 and pressure roller 32. In consideration of the fact that the transfer medium is 330 mm in width, and the pressure belt 31 is in a range of $1\times10^8$ [Ω·cm]-$1\times10^{10}$ [Ω·cm] in volume resistivity, and 20-90 μm in thickness, the electrical resistance of the fixing device 30, as the upstream electric current passage, is $1.5\times10^6$-$9.1\times10^8$Ω. More concretely, when a sheet of metallic foil, which is the same in size as the sheet of transfer medium, was placed in the nip N while the fixing device 30 was not in operation, and the electrical resistance between the ground and metallic foil was actually measured, it was confirmed that the obtained resistance was roughly the same as the abovementioned value.

As a result of the adjustment of the electrical resistance of the fixing device 30 to a value in a range of $1.5\times10^6$-$9.1\times10^8\Omega$, the transfer medium reduced in potential level by the time it arrived at the discharge guide 44, as indicated by a line "Δ" in FIG. 5(*a*), and therefore, the friction between the transfer medium and discharge guide 44 was smaller, compared to a case where there was no electric current passage. The presence of the upstream electric current passage reduce the transfer medium in potential level, also on the post-secondary-transfer guide 43. However, the transfer medium was reliably separated from the image bearing member, after the secondary transfer. Whether or not the transfer medium was reliably separated from the image bearing member was checked with the use of OK prince high quality paper (product of Oji Paper Co., Ltd.: uncoated thin paper which is 52 [g/m$^2$] in basis weight), and OK top coat (product of Oji Paper Co., Ltd.: coated paper which is 128 [g/m$^2$] in basis weight).

By the way, as the fixing device 30 is adjusted in the amount of electrical resistance to a value which is no greater than $1.5\times10^6\Omega$, the electric current which flows through the resistance Rp1 of the transfer medium increases, and therefore, the transfer medium increases in the amount of voltage reduction. Thus, the transfer medium can be further reduced in potential level as indicated by a line "X" in FIG. 5(*a*).

However, as the electrical resistance of the fixing device 30 is reduced to no more than $1.5\times10^8\Omega$, transfer medium conveyance becomes less stable immediately after the transfer medium arrives at the nip N of the fixing device 30. Thus, the transfer medium is likely to be twisted, wrinkled, and/or to suffer from the like undesirable symptoms. Before the transfer medium arrives at the fixing device 30, the transfer medium is high in potential level as indicated by a line "○". However, as the transfer medium arrives at the fixing device 30, electric current suddenly begins to flow from the transfer medium, which is high in potential level, and continues to flow until the transfer medium reduces in potential level to the level indicated by the line "x". Thus, it is reasonable to think that the greater the difference in potential level between the transfer medium and fixing device 30, which allows electric current to continue to flow, the more nonuniform the transfer medium becomes in the amount of difference in potential level between the transfer medium and fixing device 30 (pressure belt 31) in terms of the widthwise direction of the transfer medium, and therefore, the resistance to the transfer medium conveyance will be greater across the areas which are greater in the difference in potential level between the transfer medium and fixing device 30 (pressure belt 31). Therefore, it is reasonable to think that in the case of the first embodiment, it is best for the amount of the electrical resistance of the fixing device 30 to be adjusted to a value in a range of $1.5\times10^6$-$9.1\times10^8\Omega$.

On the other hand, as the electrical resistance of the fixing device 30 is adjusted to a value in a range of $9.1\times10^8\Omega$, no electric current flows through the transfer medium on the downstream side of the fixing device 30, unless there is an electric current passage on the downstream side. Therefore, the transfer medium does not reduce in voltage, remaining therefore high in potential level, until immediately before it arrives at the discharge guide 44. Therefore, there is a possibility that the transfer medium is strongly adhered to the discharge guide 44 by electrostatic force, creating large amount of resistance to transfer medium conveyance.

In the first embodiment, therefore, the discharge roller pair 45, as an example of an electrically conductive roller pair, which is disposed between the fixing device 30 and discharge guide 44, is adjusted in electrical resistance to make the discharge roller pair 45 function as the downstream electric current passage. That is, in the first embodiment, the downstream electric current passage which is provided between the post-secondary-transfer guide 43 and discharge guide 44, consists of the discharge roller pair 45 (combination of rollers 45*a* and 45*b*). The rollers 45*a* and 45*b* of the discharge roller pair 45 are grounded through the shaft of the roller 45*a* and the shaft of the roller 45*b*. The width, in terms of the transfer medium conveyance direction, by which the rollers 45*a* and 45*b* sandwich the transfer medium, is roughly 1-2 mm. The electric current having flowed to this area through the transfer medium flows through the electrically conductive PFA tube of the roller 45*a* and that of the roller 45*b*, and then, to the metallic portion of the roller 45*a* and that of the roller 45*b*. Therefore, in consideration of the fact that the transfer medium is 330 mm in width, and the PFA tube is no more than $1\times10^6\Omega$ in volume resistivity, and 10-100 μm in thickness, the electrical resistance of the discharge roller pair 45 which makes up the downstream electric current passage is in a range of $3.0\times10^2$-$1.5\times10^3\Omega$. Also in this case, the electrical resistance between the ground, and a piece of metallic foil which is the same in size as the sheet of transfer medium and was left pinched by the nip N was actually measured, while the discharge roller pair 45 was kept stationary. As a result, it was confirmed that the electrical resistance was roughly the same as the abovementioned value.

In the first embodiment, the electrical resistance of the discharge roller pair 45 was adjusted to a value in a range of $3.0\times10^2$-$1.5\times10^3\Omega$. Therefore, electric current flowed to resistor Rp2, or the portion of the transfer medium, which is between the fixing device 30 and discharge roller pair 45. Consequently, the transfer medium reduced in voltage as indicated by a line "▲" in FIG. 5(*a*). Thus, by the time the transfer medium arrived at the discharge guide 44, it sufficiently reduced in potential level to prevent the problem that the transfer medium becomes less stable in its conveyance while it is conveyed by the discharge roller unit 44 after its conveyance through the nip. That is, by the time the transfer medium arrived at the discharge roller pair 45, it had reduced in potential level. Therefore, it was possible to control the electrostatic attraction between the transfer medium and discharge guide unit 45. Thus, it was possible to reliably convey even thin paper or the like transfer medium, which is low in rigidity.

In this case, the electric current which flows from the secondary transfer roller 9 through the resistor Rp1 (through transfer medium) is greater than that before the transfer medium reaches the discharge roller pair 45, for the following reason. That is, before the transfer medium arrives at the discharge roller pair 45, it is only into the fixing device 30 that electric current flows. In comparison, after the arrival of the transfer medium at the discharge roller pair 45, electric current flows into both the fixing device 30 and discharge roller pair 45.

Therefore, the manner in which various areas of the transfer medium change in potential level changes from the manner indicated by the line "○" which represents the manner prior to the arrival of the transfer medium at the discharge roller pair 45, to the manner indicated by the line "▲" which represents the manner after the arrival of the transfer medium at the discharge roller pair 45. Therefore, while the transfer medium is on the post-secondary-transfer guide 43, it reduces in potential level, and therefore, it reduces in the ability to separate from the image bearing member, after the secondary transfer. However, the leading edge portion of the transfer medium will have been already pinched by the nip N of the fixing device 30. Therefore, such problems that the transfer medium flutters, and/or the image forming apparatus 60 reduces in performance in terms of transfer medium conveyance do not occur. These matters are confirmed with the use of OK prince high quality paper (product of Oji Paper Co., Ltd.: 52 [g/m$^2$] in basis weight: uncoated thin paper) and OK top coat (product of Oji Paper Co., Ltd.: 128 [g/m$^2$] in basis weight: coated paper).

As described above, in the first embodiment, the secondary transfer roller 9 which is an example of transferring component forms the secondary transfer section T2 by being placed in contact with the intermediary transfer belt 6 which is an example of image bearing component. The post-secondary-transfer guide 43, which is an example of electrically conductive flat component, is disposed on the immediately downstream side of the secondary transfer roller 9, in terms of the transfer medium conveyance direction, in such a manner that it faces the surface of the transfer medium, which faces the transferring member. The fixing device 30 which is an example of fixing component is disposed on the downstream side of the post-secondary-transfer guide 43 in terms of the transfer medium conveyance direction, and heats the toner image on the transfer medium, by contacting the transfer medium. The discharge roller pair 45 which is an example of transfer medium conveying component is disposed on the downstream side of the fixing device 30 in terms of the transfer medium conveyance direction, and conveys the transfer medium while keeping the transfer medium pinched by its nip N. The discharge guide 44 which is an example of transfer medium guiding component is disposed on the downstream side of the discharge roller pair 45 in terms of the transfer medium conveyance direction, and guides the transfer medium downstream, in terms of the transfer medium conveyance direction, by contacting a part of the transfer medium while the transfer medium is conveyed through the secondary transfer section T2.

The electrical resistance (which is no less than $1.5\times10^6$ and no more than $9.1\times10^8\Omega$) of the portion of the electric current passage which is between the area of contact between the fixing device 30 and transfer medium is higher than the electrical resistance (which is no less than $3.0\times10^2$ and no more than $1.5\times10^3\Omega$) of the portion of the electric current passage which is between the area of contact between the discharge roller pair 45 and transfer medium, and the ground. Therefore, the amount of reduction in the potential level of the transfer medium which occurs as the leading edge of the transfer medium comes into contact with the discharge roller pair 45 is greater than the amount of reduction in the potential level of the transfer medium, which occurs as the leading edge of the transfer medium is nipped by the nip of the fixing device 30.

The post-secondary-transfer guide 43 is made up of a grounded metallic electrode, and a resin layer which partially covers the metallic electrode and faces the transfer medium. That is, the resin layer provides the surface on which the transfer medium slides. The post-secondary-transfer guide 43 assists the separation of the transfer medium from the intermediary transfer belt 6 after the transfer medium is moved through the secondary transfer section T2. The discharge roller pair 45 is a transfer medium conveying roller pair, which conveys the transfer medium by nipping the transfer medium with its rollers 45*a* and 45*b*.

(Comparative Image Forming Apparatus)

The PFA tube of the discharge roller pair 45 of the image forming apparatus 60 was changed in volume resistivity to a value in a range of $1\times10^8$ [Ω·cm]-$1\times10^{10}$ [Ω·cm], which is the same as that for the fixing belt 36. Then, the image forming apparatus 60 was evaluated in transfer medium conveyance performance. In the case of this image forming apparatus, electric current did not sufficiently flow to the discharge roller pair 45, and therefore, the transfer medium was not optimally reduced in voltage. That is, the transfer medium reached the discharge guide 44 while remaining high in potential level. Thus, the transfer medium electrostatically adhered to the discharge guide 44, being therefore unstably conveyed.

In the first embodiment, two electric current passages, that is, the electric current passage consisting of the fixing device 30 and the electric current passage consisting of the discharge roller pair 45, were disposed in parallel between the post-secondary-transfer guide 43 and discharge guide 44. Therefore, the transfer medium was quickly reduced in potential level, and therefore, it did not occur that the image forming apparatus 60 becomes unstable in transfer medium conveyance due to sudden drop in the potential level of the transfer medium. Further, the volume resistivity of the pressure belt 31 ($1\times10^8$ [Ω·cm]-$1\times10^{10}$ [Ω·cm]) was made greater than the volume resistivity of the discharge roller pair 45 ($1\times10^6$ [Ω·cm], which is volume resistivity of PFA tube). Therefore, the transfer medium was sufficiently reduced in potential level to reduce the electrostatic attraction between the transfer medium and discharge guide 44, by the time the transfer medium arrived at the discharge guide 44 after arriving at the discharge roller pair 45. Therefore, the image forming apparatus 60 remained stable in transfer medium conveyance.

According to the first embodiment, 41, multiple (two) electric current passages, through which electric current is allowed to flow from the secondary transfer section T2 through transfer medium, are provided between the post-secondary-transfer guide 43 and discharge guide 44. Therefore, not only can transfer medium be reliably separated from the intermediary transferring member, but also, it can be reliably conveyed after the separation from the intermediary transferring member.

In the first embodiment, the upstream electric current passage in terms of the transfer medium conveyance direction consists of the fixing device 30. That is, the pressure belt 31 of the fixing device 30 is grounded through the shaft of the pressure roller 32. The width of area across which the pressure roller 32 and fixing roller 37 pinch the transfer medium with the presence of the pressure belt 31 between the two rollers 32 and 37, is roughly 1-3 mm. The electric current having flowed through the transfer medium flows into this area. Then, it flows to the ground through the pressure belt 31 and pressure roller 32. Thus, in consideration of the fact that the transfer medium is 330 mm in width, and also, that the pressure belt 31 is $1\times10^8$ [Ω·cm]-$1\times10^{10}$ [Ω·cm] in volume resistivity, and 20-90 μm in thickness, the amount of the electrical resistance of the fixing device 30 which makes up the upstream electric current passage is no less than $1.5\times10^6\Omega$ and no more than $9.1\times10^8\Omega$.

In the first embodiment, the downstream electric current passage in terms of the transfer medium conveyance direction consists of the discharge roller pair 45. The rollers 45*a* and 45*b* of the discharge roller pair 45 are grounded through the shaft of the roller 45*a* and the shaft of the roller 45*b*. The width, in terms of the transfer medium conveyance direction, by which the transfer medium is pinched by the rollers 45*a* and 45*b* is roughly 1-2 mm. The electric current flows into this area through the transfer medium, and then, flows to the ground through the electrically conductive PFA tube of the roller 45*a* and that of the roller 45*b*, and the metallic roller in the roller 45*a* and that of the roller 45*b*. Therefore, in consideration of the fact that the transfer medium width is 330 mm, and the PFA tube is no less than $1.5\times10^6$ [Ω·cm] in volume resistivity, and 10-100 μm in thickness, the amount of the electrical resistance of the discharge roller pair 45 as a part of the electric current passage is no less than $3.0\times10^2$ and no more than $1.5\times10^3\Omega$.

Embodiment 2

Figure 6:
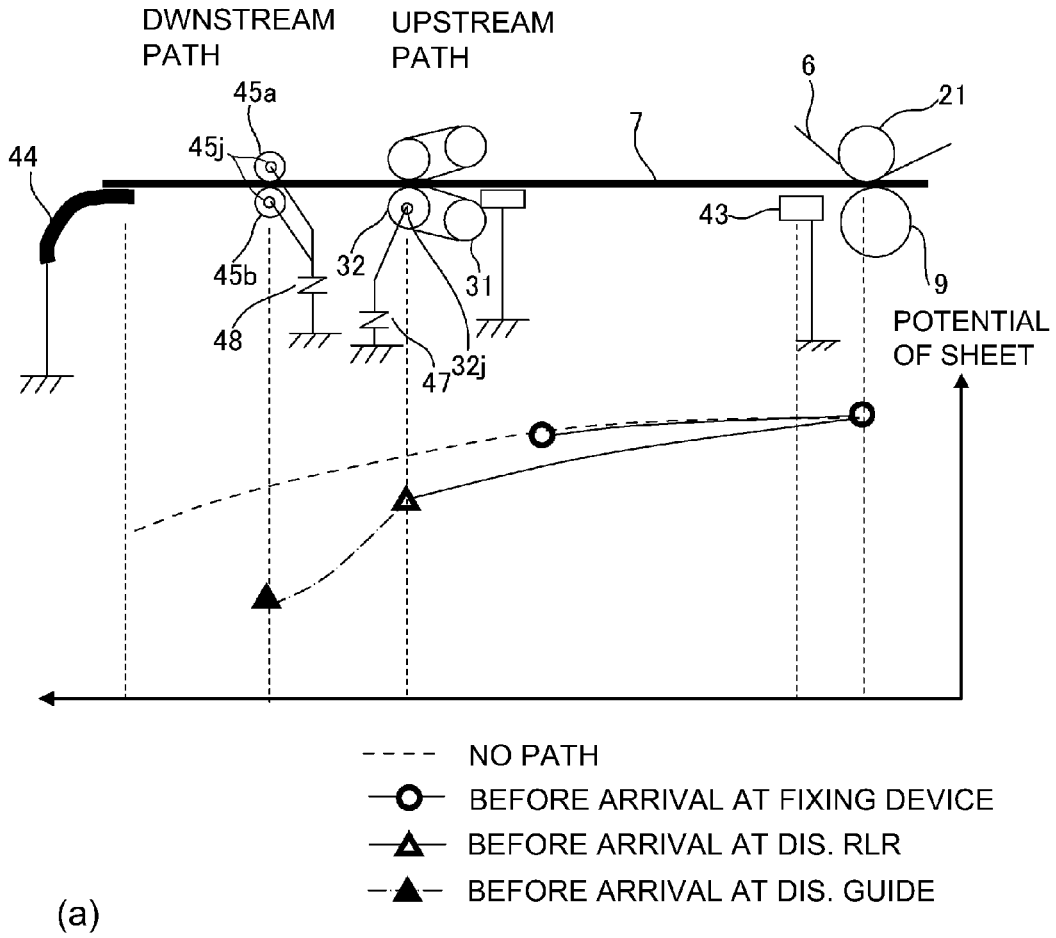
FIG. 6 is a drawing for describing the structure of the system, in the second embodiment of the present invention, for controlling the transferring component in potential after the secondary transfer.
Figure 6:
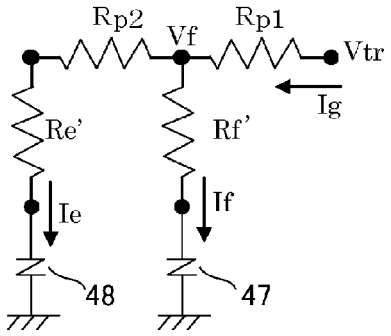

FIG. 6 is a drawing for describing the structure of the system, in the second embodiment, for controlling the transfer medium in potential level after the secondary transfer. In the case of the image forming apparatus in the second embodiment, the pressure roller 32 of the fixing device 30 is grounded through a pair of semiconductors (varistors) 47 and 48, instead of the "resistors". The varistors 47 and 48 are set so that they are relatively small in the amount of their electrical resistance (Re' and Rf" respectively). Otherwise, the image forming apparatus in this embodiment is the same in structure and control as the image forming apparatus 60 in the first embodiment. Therefore, the structural components and configuration of the image forming apparatus in this embodiment, which are the same as the counterparts in the first embodiment, are given the same referential codes as those given to the counterparts in order not to repeat the same descriptions.

Referring to FIG. 6, in the second embodiment, the pressure belt 31 of the fixing device 30 is grounded through the varistor 47. More specifically, the shaft 32*j* of the pressure roller 32 which is one of the rollers by which the pressure belt 31 is suspended and kept tensioned is grounded through a semiconductor which is variable in the amount of electrical resistance in a range of 750 V-1.2 kV. In this embodiment, the volume resistivity of the pressure roller 32 is set lower (in range of $1\times10^7$ [Ω·cm]-$1\times10^9$ [Ω·cm]) than in the first embodiment. That is, the electrical resistance RF' of the portion of the upstream electric current passage between the secondary transfer section T2 and varistor 47, which is measured, with a piece of metallic foil, which is the same in dimension in terms of the transfer medium conveyance direction, being nipped, is adjusted to a value in a range of $1.5\times10^5\Omega$-$9.1\times10^7\Omega$.

The nip N of the fixing device 30 is grounded through the varistor 47. Therefore, the transfer medium remains stable in potential level while the transfer medium remains nipped by the nip N of the fixing device 30, and also, while the transfer medium is on the post-secondary-transfer guide 43 which is on the immediately downstream side of the secondary transfer section T2. Therefore, the image forming apparatus is stable in transfer medium separation. Further, as the transfer medium is nipped by the fixing device 30 while it is moved through the secondary transfer section T2, the state of the transfer medium in terms of potential level changes from the state indicated by a line "○" in FIG. 6 to the state indicated by a line "Δ" in FIG. 6. However, while the transfer medium is on the post-secondary-transfer guide 43 which is on the immediately downstream side of the secondary transfer section T2, the electrical potential of the transfer medium is retained by a certain amount. That is, the while the transfer medium is on the post-secondary-transfer guide 43, it remains relatively high in potential level. Therefore, the image forming apparatus is stable in terms of the separation of the transfer medium from the intermediary transfer belt 6 by the post-secondary-transfer guide 43.

However, in a case where the varistor 48 is not provided, electric current does not flow to the resistor Rp2, that is, the resistance of the portion of transfer medium, which is between the secondary transfer roller 9 and fixing device 30. Therefore, the portion of the transfer medium, which is equivalent to the resistor Rp2, does not drop in voltage, as indicated by a broken line in FIG. 6. That is, the amount by which the leading edge portion of the transfer medium reduces in voltage is only the amount by which the voltage of the transfer medium attenuates by itself. Thus, while the transfer medium is on the post-secondary-transfer guide 43, it remains high in potential level. Therefore, it is ensured that the transfer medium is reliably separated from the intermediary transfer belt 6 by the post-secondary-transfer guide 43. In this case, however, the leading edge portion of the transfer medium remains high in potential level even at the point at which the transfer medium arrives the discharge guide 44. Therefore, the transfer medium is electrically adhered to the discharge guide 44, increasing thereby the resistance to transfer medium conveyance. Thus, it is possible that the image forming apparatus will become unstable in terms of transfer medium conveyance.

In this embodiment, therefore, the shaft 45*j* of the roller 45*a* of the discharge roller pair 45, and the shaft 45*j* of the roller 45*b* of the discharge roller pair 45, are grounded through the varistor 48, as a voltage control element, which is lower (120 V) in regulatory voltage than the varistor 47. Further, referring to FIG. 6(*b*), in order to enhance the electrical discharge which occurs through the varistor 48 as the transfer medium arrives at the discharge roller pair 45, the discharge resistor Re' is set smaller in electrical resistance than the "resistors" in the first embodiment. More concretely, the volume resistivity of the PFA tube which covers the roller 45*a* and that of the PFA tube which covers the roller 45*b* are set to no more than $1\times10^6$ [Ω·cm]. Further, an adjustment is made so that the resistance of the portion of the electric current passage which is between the discharge roller pair 45 and the varistor 48, which was measured with the placement of a piece of metallic foil which is the same in width in terms of the transfer medium conveyance direction as the transfer medium, in the nip of the fixing device 30, become no more than $2.0\times10^2$-$1.0\times10^3\Omega$. Therefore, the portion of the transfer medium, which on the leading edge side of the discharge roller pair 45, can be induced to drop in voltage, by causing electric current to flow to the portions of the transfer medium, which are equivalent to resistors Rp1+Rp2, through the discharge roller pair 45, by a greater amount than in the first embodiment, in order to reduce the transfer medium in potential level when the transfer medium begins to slide on the discharge guide 44.

As the leading edge portion of the transfer medium is nipped by the discharge roller pair 45, the portion of the transfer medium, which is on the post-secondary-transfer guide 43, reduces in potential level as well, as indicated by a curved line "Δ" in FIG. 6(*a*). However, it is ensured that the transfer medium reliably separate from the intermediary transfer roller 6 as it comes out of the secondary transfer section T2. This was confirmed with the use of OK prince high quality paper (52 [g/m$^2$] in basis weight) (product of Oji Paper Co., Ltd.), which is an example of uncoated thin paper, and OK top coat (128 [g/m$^2$] in basis weight) (product of Oji Paper Co., Ltd.), which is an example of coated paper.

As described above, in the second embodiment, the varistor 48 which is an example of the constant voltage generation element, is disposed between the discharge roller pair 45 and ground, being thereby enabled to regulate in potential level, the portion of the transfer medium, which is in contact with the discharge roller pair 45. The varistor 47 which is an example of the second constant voltage generation element is higher in the voltage it generates than the varistor 48. It is disposed between the fixing device 30 and ground, being thereby enabled to regulate in potential level, the portion of the transfer medium, which is in contact with of the fixing device 30. Each of the varistors 47 and 48 is such a semiconductor that is affected in the amount of its electrical resistance by the voltage applied between its terminals; when a voltage which is smaller than a preset voltage is applied between the terminals of the semiconductor, its electrical resistance is greater than when the preset voltage is applied. Therefore, it can prevent the transfer medium from being reduced in potential level by an amount greater than the desired amount.

In the second embodiment, therefore, when the transfer medium is in contact with the discharge roller pair 45, it is stabilized in potential level by the varistor 48 at 120 V. Therefore, the transfer medium is kept low in potential level until it reaches the discharge guide 44. Therefore, the adhesion of the transfer medium to the discharge guide 44 can be reliably regulated. In the second embodiment, not only is the image forming apparatus provided with the same structural feature as that in the first embodiment, but also, the fixing device 30 and discharge roller pair 45 are grounded through the varistors 47 and 48, respectively. Therefore, while the transfer medium is conveyed through its conveyance passage, it remains stable in potential level, and therefore, it is possible to keep stable the difference in potential level between the post-secondary-transfer guide 43 and transfer medium, and the potential level of the transfer medium prior to the arrival of the transfer medium at the discharge guide 44.

Miscellaneous Embodiments

The present invention is also applicable to an image forming apparatus which is partially or entirely different in structure from those in the preceding embodiment, as long as the apparatus is structured so that a potential level regulating means is disposed between its fixing device and transfer medium rubbing components to delay the timing with which the transfer medium reduces in potential level.

That is, the combination of the electrically resistant component Rf' of the fixing device 30 and the electrical resistant component Re' of the discharge roller pair, which are connected to the varistors 47 band 48, respectively, shown in FIG. 6(*b*) does not need to be limited to the one in the second embodiment. For example, it may be equivalent to the combination of the electrical resistors in the first embodiment. Further, the combination of the regulatory voltages V47 and V48 of the varistors 47 and 48, respectively, is optional as long as the relationship between V47 and V48 is maintained so that "V47<V48" is satisfied. It is desired that in terms of state of contact, the discharge roller evenly contacts the transfer medium across the entirety of the transfer medium in terms of the widthwise direction of the transfer medium. However, the state of contact between the discharge roller and transfer medium does not need to be perfectly uniform, as long as the transfer medium is satisfactorily conveyed. Various numerical values mentioned in the description of the preceding embodiments of the present invention should be experimentally optimized in consideration of various factors.

The choice of an image bearing component does not need to be limited to an intermediary transfer belt. It may be a photosensitive drum, for example. The present invention is applicable regardless of whether an image forming apparatus has only one image bearing component, or is of the so-called tandem type. The present invention is applicable regardless of photosensitive component count, charging method, electrostatic image formation method, transferring method, fixation method, etc. In the foregoing, only the main portions of the image forming apparatus, that is, the portions of the image forming apparatus, which are involved in the formation and transfer of a toner image, were described. However, the present invention is also applicable to various image forming apparatuses, which are different in usage from those in the preceding embodiments. For example, it is applicable to a copying machine, a facsimile machine, a multifunction machine, etc., which are combinations of one of the image forming apparatuses in the preceding embodiments, and additional devices, equipments, casings, and/or the like structural components.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 224110/2013 filed Oct. 29, 2013, which is hereby incorporated by reference.

What is claimed is:

1. An image forming apparatus comprising:

a rotatable image bearing member configured to carry a toner image;

a transfer member configured to contact said image bearing member to form a transfer nip, said transfer member being capable of electrostatically transferring the toner image from said image bearing member onto a recording material using an electric field applied to said transfer member;

an electroconductive member provided adjacent to a downstream side of said transfer member with respect to a feeding direction of the recording material and opposed to a transfer member side surface of the recording material, said electroconductive member being configured to apply an electrostatic attraction force to the recording material;

a fixing unit provided downstream of said transfer member with respect to the feeding direction and configured to fix the toner image on the recording material having the transferred toner image fed into a fixing nip;

a first current path provided between fixing nip and a ground potential;

a feeding unit provided downstream of said fixing unit with respect to the feeding direction and configured to feed the recording material while nipping by a feeding nip;

a guiding member disposed at a position which is downstream of said feeding unit and in which a downstream side of the recording material contacts said guiding member when the recording material is nipped at the transfer nip to which the electric field is applied, with respect to the feeding direction, said guiding member being configured to guide the feeding of the recording material passing through the transfer nip; and a second current path provided between the feeding nip and the ground potential, said second current path having an electric resistance which is lower than that of said first current path.

2. An apparatus according to claim 1, wherein said first current path includes a first constant voltage generating element which generates a predetermined voltage by a current flowing therethrough, and said second current path includes a second constant voltage generating element which generates a voltage, which is lower than the predetermined voltage, by a current flowing therethrough.

3. An apparatus according to claim 1, wherein said first current path has an electric resistance of not less than 1.5×

$10^6\Omega$ and not more than $9.1\times10^8\Omega$, and said second current path has an electric resistance of not less than $3.0\times10^2\Omega$ and not more than $1.5\times10^3\Omega$.

4. A apparatus according to claim 1, wherein said feeding unit includes a pair of feeding rollers, at least one of which is electroconductive, said feeding rollers constituting the feeding nip configured to nip and feed the recording material.

5. A apparatus according to claim 1, wherein said electroconductive member is provided with an electroconductive surface which is electrically connected with a ground potential and which is substantially in parallel with a surface of the recording material fed by the transfer nip.

6. An apparatus according to claim 5, wherein said electroconductive member electrostatically assists separation of the recording material, having passed through the transfer nip, from said image bearing member.

* * * * *